US006328094B1

(12) United States Patent
Mori et al.

(10) Patent No.: US 6,328,094 B1
(45) **Date of Patent: *Dec. 11, 2001**

(54) ROTARY TYPE REGENERATIVE HEAT EXCHANGER

(75) Inventors: Yasushi Mori; Akira Hashimoto, both of Nagasaki; Junichi Miyagawa, Shimonoseki, all of (JP)

(73) Assignee: Mitsubishi Heavy Industries Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 148 days.

(21) Appl. No.: 09/192,035

(22) Filed: Nov. 13, 1998

(30) Foreign Application Priority Data

Dec. 19, 1997 (JP) ..... 9-349876

(51) Int. Cl.[7] ..... F23L 15/02

(52) U.S. Cl. ..... 165/8; 165/9; 165/10; 165/DIG. 18

(58) Field of Search ..... 165/6, 8, 10, 9, 165/108, DIG. 16, DIG. 18

(56) References Cited

U.S. PATENT DOCUMENTS

| | | | | |
|---|---|---|---|---|
| 2,665,120 | | 1/1954 | Blomquist | 257/6 |
| 2,892,616 | * | 6/1959 | Firgau | 165/9 |
| 3,122,200 | | 2/1964 | Koch | 165/9 |
| 3,241,764 | * | 3/1966 | Dawley et al. | 165/9 |
| 3,880,225 | * | 4/1975 | Penny | 165/9 |
| 4,040,474 | | 8/1977 | Stroom et al. | 165/9 |
| 4,174,748 | * | 11/1979 | Denjean | 165/9 |
| 4,542,782 | * | 9/1985 | Berner | 165/9 |

FOREIGN PATENT DOCUMENTS

| | | | | |
|---|---|---|---|---|
| 250 167 A1 | | 9/1987 | (DD) . | |
| 1170106 | * | 5/1964 | (DE) . | |
| 3325 140 A1 | | 1/1985 | (DE) . | |
| 42 30 133 A1 | * | 3/1994 | (DE) . | |
| 0 498 020 A1 | | 8/1992 | (EP) . | |
| 1168896 | * | 12/1958 | (FR) . | |
| 2 154 468 | | 9/1985 | (GB) . | |
| 0121398 | * | 9/1980 | (JP) | 165/10 |

* cited by examiner

*Primary Examiner*—Christopher Atkinson
(74) *Attorney, Agent, or Firm*—Myers Bigel Sibley & Sajovec, P.A.

(57) ABSTRACT

There is provided a rotary type regenerative heat exchanger which can effectively prevent an air bypass leak or a gas bypass leak. A rotary type regenerative heat exchanger of the present invention has a rotor (4) rotating around a central shaft (2), a heat accumulator (8) which is constructed in a manner that an air (A) of being a heated fluid and a gas (G) of being a heating fluid filled in the rotor alternately pass therethrough by a rotation of the rotor to repeat heat accumulation and radiation, and a housing provided so as to house the rotor. Further, the rotary type regenerative heat exchanger comprises: a branch pipe (41, 47, 55) for taking out a part of the heating fluid; a seal gas fan (42, 48, 56) for pressurizing the taken-out heating fluid to a predetermined pressure; and a seal gas introducing duct (46, 52) which is provided in the housing so as to introduce the pressurized heating fluid into a predetermined space formed between the rotor and the housing.

6 Claims, 7 Drawing Sheets

ROTARY TYPE REGENERATIVE HEAT EXCHANGER

BACKGROUND OF THE INVENTION

The present invention relates to a rotary type regenerative heat exchanger, and in particular, to a rotary type regenerative heat exchanger which is applicable to a steam power plant, an internal combustion engine or the like.

Conventionally, there has been known a rotary type regenerative heat exchanger which is called as an air heater for preheating a combustion air in a boiler or the like. A structure of the conventional rotary type regenerative heat exchanger will be explained below with reference to FIG. 6 and FIG. 7.

As shown in FIG. 6, a rotary type regenerative heat exchanger 1 includes a cylindrical rotor 4 rotating around a central shaft 2, and a housing 6 arranged so as to house the rotor 4. The rotor 4 is provided with a heat accumulator 8 which repeats accumulation and radiation. An upper portion of the housing is provided with an air outlet duct 10 at the right-hand half portion, and a gas inlet duct 12 at the left-hand half portion. On the other hand, a lower portion of the housing 6 is provided with an air inlet duct 14 at the left-hand half portion, and a gas outlet duct 16 at the right-hand half portion.

In the rotary type regenerative heat exchanger 1 thus constructed, when the rotor 4 rotates, the heat accumulator 8 is alternately exposed to an air A and a gas G, and then, repeats an operation of accumulating a heat of the gas and radiating it to the air A, and thereby, the heat of gas G being recovered into the air A.

For example, in a steam power plant, the aforesaid rotary type regenerative heat exchanger 1 is arranged as shown in FIG. 7. In FIG. 7, the air A, which is a combustion air supplied to a boiler 18, is supplied into the rotary type regenerative heat exchanger 1 by means of a fan (not shown), and then, is supplied to the boiler 18 after the temperature of air A rises by a heat exchange made by the rotary type regenerative heat exchanger 1. A part of the gas G discharged from the boiler 18 is again returned to the boiler as a re-circulating gas GR by means of a circulating gas fan 20. On the other hand, the remainder of the gas G is supplied to the rotary type regenerative heat exchanger 1, and then, the temperature of the gas G is lowered by making a heat exchange with the air A. Thereafter, the gas G is supplied to a chimney stack (not shown) so as to be discharged to the atmosphere.

In the rotary type regenerative heat exchanger 1 shown in FIG. 7, an inlet air pressure (Pai), an outlet air pressure (Pao), an inlet gas pressure (Pgi) and an outlet gas pressure (Pgo) have the following relationship.

$$Pai > Pao > Pgi > Pgo$$

As is evident from the above relationship, in the rotary type regenerative heat exchanger 1, various leaks of the air A and the gas G are generated by the difference in pressure between the air side and the gas side.

These leaks include the following leaks. More specifically, there are a high temperature radial leak (HRL) which is generated in an upper end face of the rotor 4 on the inlet and outlet of the air A and the gas G, a low temperature radial leak (LRL) which is generated in a lower end face of the rotor 4 (see FIG. 7), a post leak (PL) which is generated around the central shaft 2 of the inlet and outlet of the air A and the gas G, an air bypass leak (ABL) which bypasses a space between the rotor 4 and the housing 6 on the air side, an gas bypass leak (GBL) which bypasses a space between the rotor 4 and the housing 6 on the gas side (see FIG. 7), and an axial leak (AL) which flows from the air side to the gas side in the space between the rotor 4 and the housing 6.

In order to reduce these leaks, as shown in FIG. 6, the conventional rotary type regenerative heat exchanger 1 is provided with the following seals at the rotor 4 side; more specifically, a radial seal 22 which radially extends so as to seal a space between the air side and the gas side in the upper and lower end faces of the rotor 4, a rotor post seal 24 which is located around the central shaft 2 of the inlet and outlet of the air A and the gas G, a ring-like bypass seal 26 which is located on an outer peripheral edge on the upper and lower end faces of the rotor 4, and an axial seal 28 which is vertically located at an outer peripheral portion of the rotor 4 so as to seal the air side and the gas side.

On the other hand, the conventional rotary type regenerative heat exchanger 1 is provided with the following seals at the housing 6 side; more specifically, a sector plate 30 which is located facing the upper and lower end faces of the rotor 4 so as to seal a space between the air side and the gas side in the upper and lower end faces of the rotor 4, and an axial plate 32 which is vertically located along an outer peripheral portion of the rotor 4 so as to seal the air side and the gas side.

In the conventional rotary type regenerative heat exchanger 1 having the structure as described above, the radial seal 22, rotor post seal 24, bypass seal 26 and the axial seal 28, which are attached to the rotor 4, slidably move on the sector plate 30 and the axial plate 32 fixed to the housing 6, and a leak has been prevented by a mechanical contact of these plates with seals. However, according to the aforesaid structure such that the leak is prevented by a mechanical contact, in the case where the rotor 4 thermally deforms, and then, a gap between the plate and the seal becomes a state different from a design value, there has arisen a problem that sufficient seal effect is not obtained.

Further, as shown in FIG. 7, by a generation of the air bypass leak ABL, a low temperature air A on the inlet and a high temperature air A on the outlet are mixed in the rotary type regenerative heat exchanger 1. As a result, the temperature of air A on the outlet lowers as compared with the case of no leak. For this reason, the temperature of the combustion air A supplied to the boiler 18; as a result, there has arisen a problem that the heat efficiency of the boiler 18 is lowered by the decrement in temperature.

Moreover, as shown in FIG. 7, by a generation of the gas bypass leak GBL, the quantity of gas which is used as a heating fluid decreases in the rotary type regenerative heat exchanger; as a result, there has arisen a problem that the heat efficiency of the boiler 18 is lowered by the decrement in quantity.

SUMMARY OF THE INVENTION

In view of such circumstances, the present invention has been made in order to solve the aforesaid problems in the prior art. Therefore, an object of the present invention is to provide a rotary type regenerative heat exchanger which can effectively prevent an air bypass leak or a gas bypass leak.

Further, another object of the present invention is to provide a rotary type regenerative heat exchanger which can effectively prevent an air bypass leak or a gas bypass leak, and can improve a heat efficiency of a boiler.

To achieve the above object, the present invention provides a rotary type regenerative heat exchanger comprising:

a rotor rotating around a central shaft;

a heat accumulator which is constructed in a manner that a heated fluid and a heating fluid filled in the rotor alternately pass therethrough by a rotation of the rotor to repeat heat accumulation and radiation;

a housing provided so as to house the rotor;

take-out means for taking out a part of the heating fluid;

pressurizing means for pressurizing the taken-out heating fluid to a predetermined pressure; and a pressurized fluid introducing passage which is provided in the housing so as to introduce the pressurized heating fluid into a predetermined space formed between the rotor and the housing.

In the rotary type regenerative heat exchanger thus constructed according to the present invention, the heated fluid and the heating fluid alternately pass through the heat accumulator by the rotation of the rotor, and then, the heat accumulator repeats an operation of accumulating a heat of the heating fluid and radiating it to the heated fluid, and thus, the heat of the heating fluid is recovered to the heated fluid. Further, a part of the heating fluid is taken out by means of the take-out means, and then, the taken-out heating fluid is pressurized to a predetermined pressure, and thus, by means of the pressurized fluid introducing passage, the pressurized heating fluid is introducing into a predetermined space between the rotor and the housing. As a result, the pressure of the space becomes high; therefore, it is possible to effectively prevent an air bypass leak which has conventionally generated.

In summary, the rotary type regenerative heat exchanger can effectively prevent an air bypass leak or a gas bypass leak, and can improve a heal efficiency of the boiler.

In the present invention, the pressurized fluid introducing passage may be provided on a heated fluid side of the housing, a heating fluid side of the housing, or on both heated fluid side and heating fluid side of the housing.

In the present invention, the take-out means may branch and take out a part of the heating fluid before or after passing through the heat accumulator.

DETAILED DESCRIPTION OF THE PREFERRED EMBODIMENT

Figure 1:
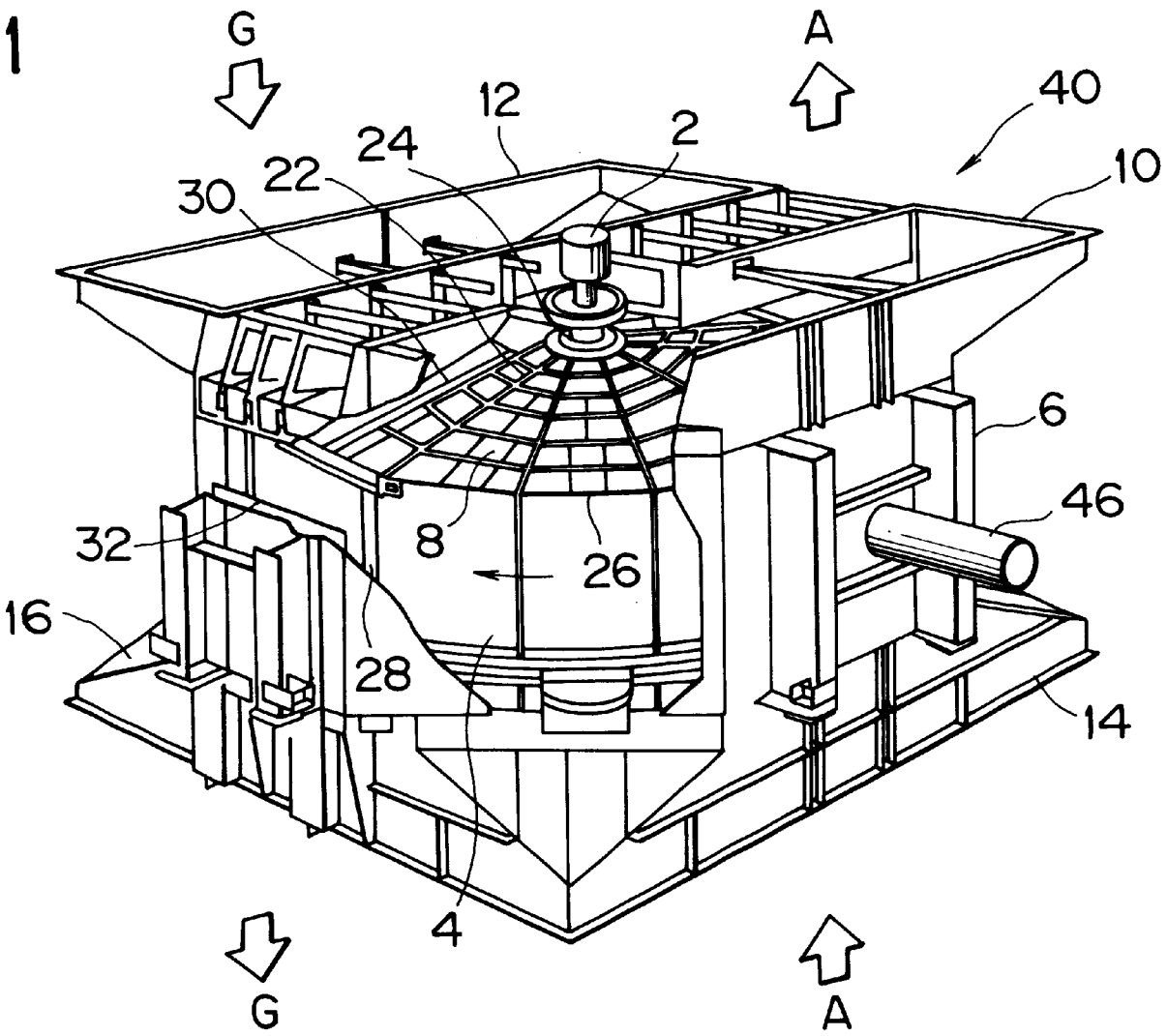
FIG. 1 is a perspective view in partly cross section showing a rotary type regenerative heat exchanger according to a first embodiment of the present invention.

Embodiments of the present invention will be described below with reference to the accompanying drawings, that is, FIG. 1 to FIG. 5. In these drawings, like reference numerals are used to designate the same components as those in the prior art, and their details are omitted.

Figure 2:
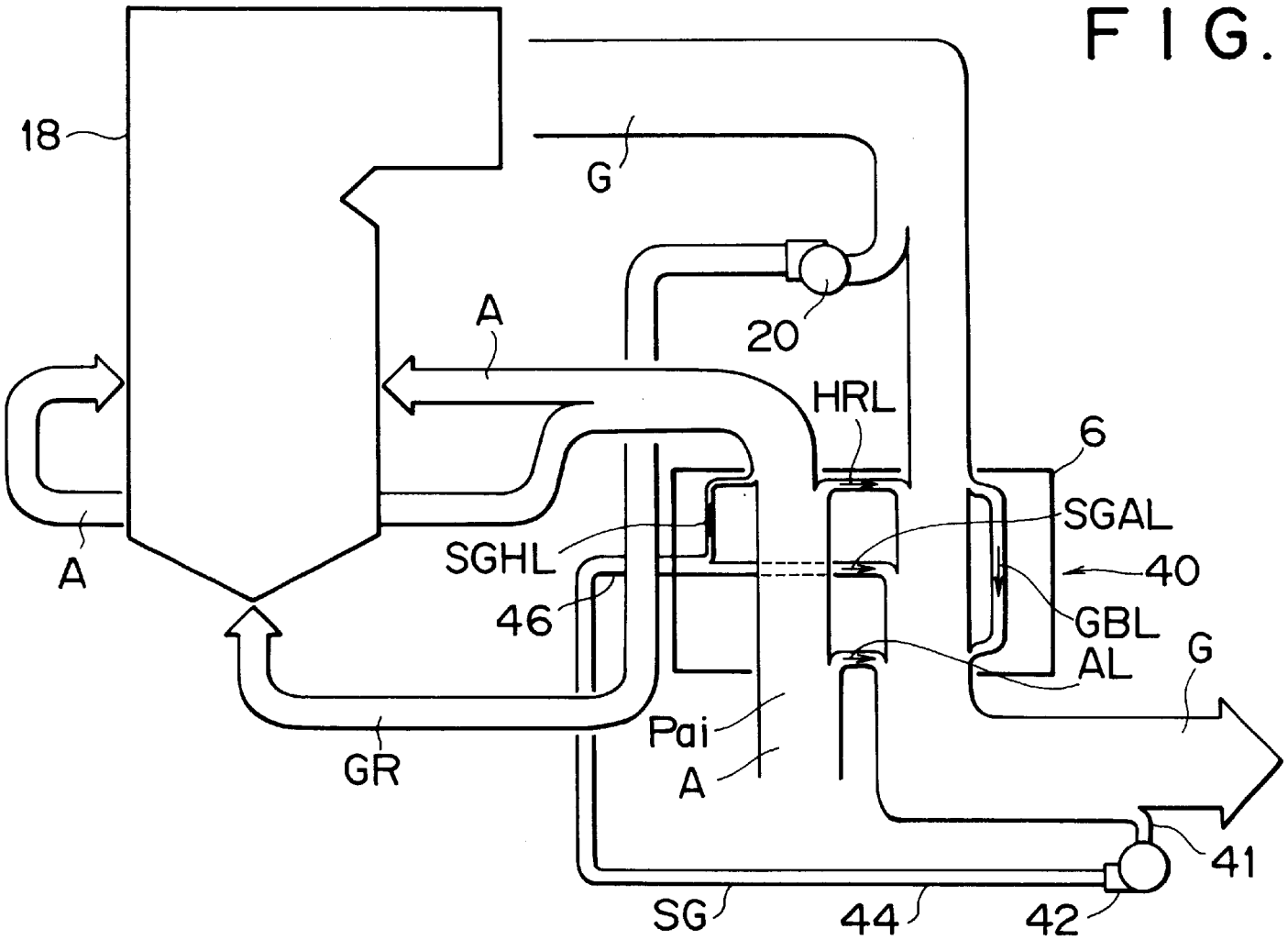
FIG. 2 is a view schematically showing the whole construction of a boiler and the rotary type regenerative heat exchanger according to the first embodiment of the present invention.

First, a rotary type regenerative heat exchanger according to a first embodiment of the present invention will be explained below with reference to FIG. 1 and FIG. 2. FIG. 1 is a perspective view in partly cross section showing a rotary type regenerative heat exchanger according to the present invention, and FIG. 2 is a view schematically showing the whole construction of a boiler and a rotary type regenerative heat exchanger according to the first embodiment of the present invention.

According to the first embodiment of the present invention, in order to take out a part of gas which is discharged from a rotary type regenerative heat exchanger 40 and flows into a chimney stack (not shown), the rotary type regenerative heat exchanger 40 is provided with a branch pipe 41 at an outlet thereof. The branch pipe 41 is connected with a seal gas fan 42 for applying a pressure to the taken-out gas. A seal gas pipe 44 is arranged on a downstream side of the seal gas fan 42. Further, the seal gas pipe 44 is connected to a seal gas introducing duct 46 which is attached to the housing on the air side, and has one end opening in a space between the rotor 4 and the housing 6 on the air side. In this case, a seal gas SG is pressurized by means of the seal gas fan 42, and then, is set to a value of the aforesaid inlet air pressure (Pai) or more.

Subsequently, an operation of the rotary type regenerative heat exchanger thus constructed according to the first embodiment will be explained below. A part of gas, which is discharged from the rotary type regenerative heat exchanger 40 and flows into a chimney stack (not shown), is taken out from the branch pipe 41 as a seal gas SG, and then, is pressurized to a value of the inlet air pressure (Pai) or more by means of the seal gas fan 42. The pressurized seal gas SG reaches the seal gas introducing duct 46 via the seal gas pipe 44, and then, is introduced from the seal gas introducing duct 46 into a space surrounded by the rotor 4, the housing 6 on the air side, the bypass seal 26 and the axial seal 28.

As a result, the pressure of the space becomes high; therefore, it is possible to effectively prevent an air bypass leak ABL which has conventionally generated. Further, since the air bypass leak ABL is effectively prevented, a low temperature air A on the outlet does not mix with a high temperature air A on the outlet. Therefore, the temperature of air A on the outlet becomes high, so that a heat efficiency of the boiler can be improved.

In this first embodiment, the seal gas SG introduced in the aforesaid space flows into an air outlet side as a seal gas high temperature leak SGHL, and then, is mixed into the air A on the outlet. Since the temperature of the seal gas SG at this time is higher than the inlet air temperature, there is almost no influence of lowering the heat efficiency of the boiler 18 as compared with the conventional rotary type regenerative heat exchanger in which the air bypass leak ABL is generated. Also, the seal gas axial leak SGAL is generated; however, this seal gas axial leak has no any influence on the heat efficiency of the boiler 18.

In the first embodiment, there is a need of additionally providing the seal gas fan 42 or the like as compared with the conventional rotary type regenerative heat exchanger.

However, the cost for providing the seal gas fan is extremely slight, and it is possible to improve a heat efficiency of the whole of steam power plant which comprises the boiler 18 and the rotary type regenerative heat exchanger 40, as compared with the conventional one.

Figure 3:
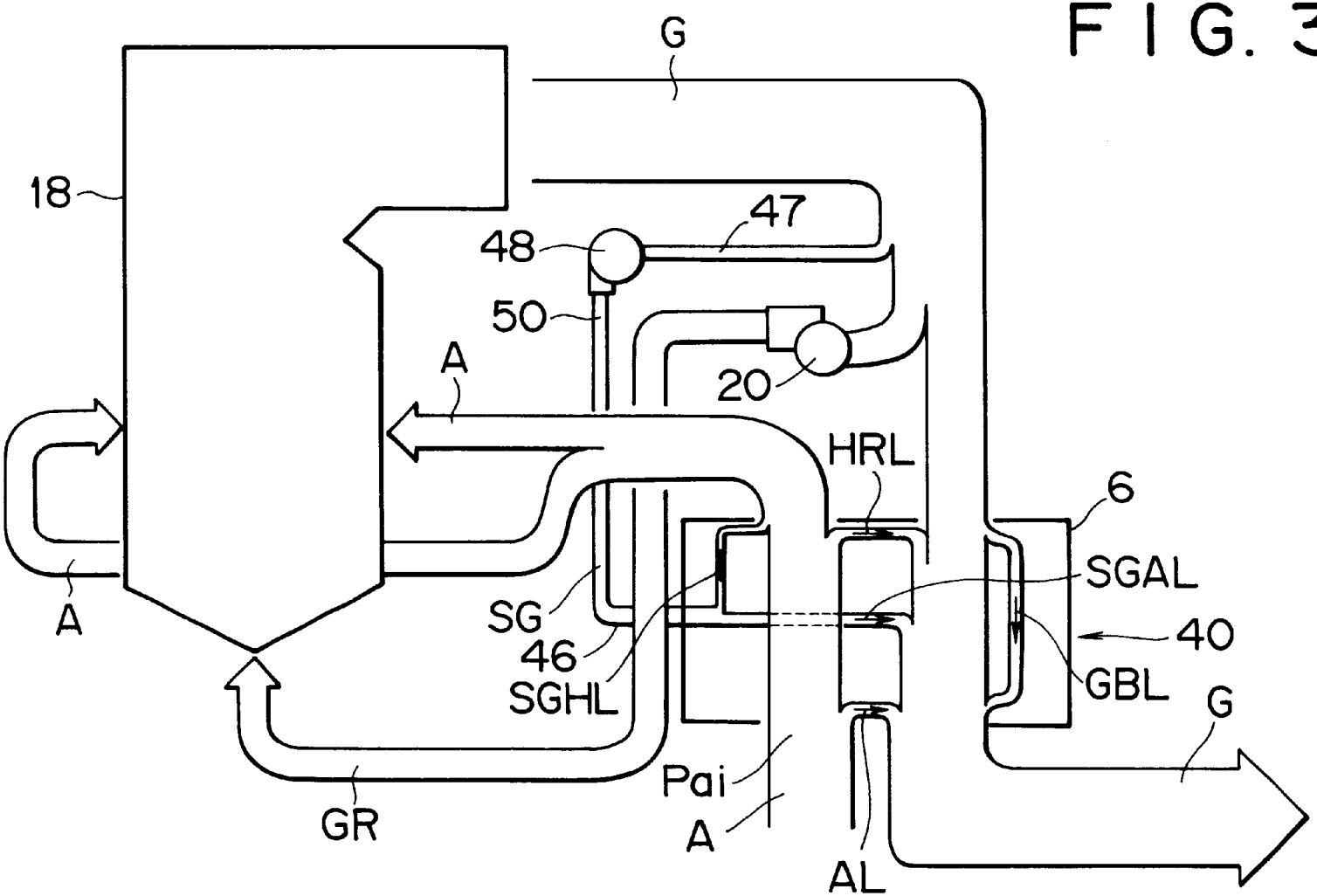
FIG. 3 is a view schematically showing the whole construction of a boiler and a rotary type regenerative heat exchanger according to a second embodiment of the present invention.

Next, a rotary type regenerative heat exchanger according to a second embodiment of the present invention will be explained below with reference to FIG. 3. FIG. 3 is a view schematically showing the whole construction of a boiler and a rotary type regenerative heat exchanger according to the second embodiment of the present invention.

In this second embodiment, a branch pipe 47 is provided at an upstream side from a position locating the rotary type regenerative heat exchanger 40 and a circulating gas fan 20, and then, branches and takes out a part of gas which is discharged from the boiler 18 and flows into the rotary type regenerative heat exchanger 40. Further, the branch pipe 47 is provided with a seal gas fan 48 for applying a pressure to the taken-out gas. A seal gas pipe 50 is arranged on a downstream side of the seal gas fan 48. Further, the seal gas pipe 50 is connected to a seal gas introducing duct 46 which is attached to the housing 6 on the air side and has one end opening in a space between the rotor 4 and the housing 6 on the air side. In this case, a seal gas SG is pressurized by means of the seal gas fan 48, and then, is set to a value of the aforesaid inlet air pressure (Pai) or more, like the above first embodiment.

An operation of the rotary type regenerative heat exchanger thus constructed according to the second embodiment will be explained below. A part of gas, which is discharged from the boiler 18, is taken out from the branch pipe 47 as a seal gas SG at an upstream side from a position locating a rotary type regenerative heat exchanger 40 and a circulating gas fan 20, and then, is pressurized to a value of the inlet air pressure (Pai) or more by means of the seal gas fan 48. The pressurized seal gas SG reaches the seal gas introducing duct 46 via the seal gas pipe 50, and then, is introduced from the seal gas introducing duct 46 into a space surrounded by the rotor 4, the housing 6 on the air side, the bypass seal 26 and the axial seal 28.

As a result, the pressure of the space becomes high; therefore, it is possible to effectively prevent an air bypass leak ABL which has conventionally generated. Further, since the air bypass leak ABL is effectively prevented, a low temperature air A on the inlet does not mix with a high temperature air A on the outlet. Therefore, the temperature of air A on the outlet becomes high, so that a heat efficiency of the boiler can be improved.

In this second embodiment, the seal gas SG is taken out from a high temperature gas on the upstream side from the position locating the rotary type regenerative heat exchanger 40 and the circulating gas fan 20. Thus, there is almost no influence of lowering the heat efficiency of the boiler 18.

Also, in the second embodiment, the seal gas SG introduced into the aforesaid space flows to the outlet side of air as a seal gas high temperature leak SGHL, and then, is mixed into the air A on the outlet side, like the above first embodiment. Since the temperature of the seal gas SG at this time is higher than the inlet air temperature, there is almost no influence of lowering the heat efficiency of the boiler 18 compared with the conventional rotary type regenerative heat exchanger in which an air bypass leak ABL has generated. Further, a seal gas axial leak SGAL is generated; however, the leak has no influence on the heat efficiency of the boiler 18.

Further, in this second embodiment, it is possible to improve a heat efficiency in the whole steam power plant which comprises the boiler 18 and the rotary type regenerative heat exchanger 40 as compared with the conventional one, like the above first embodiment.

In this second embodiment, the pressure of the taken-out seal gas SG is higher than the case of the first embodiment; therefore, it is possible to make small a capacity of the seal gas fan 48.

Figure 4:
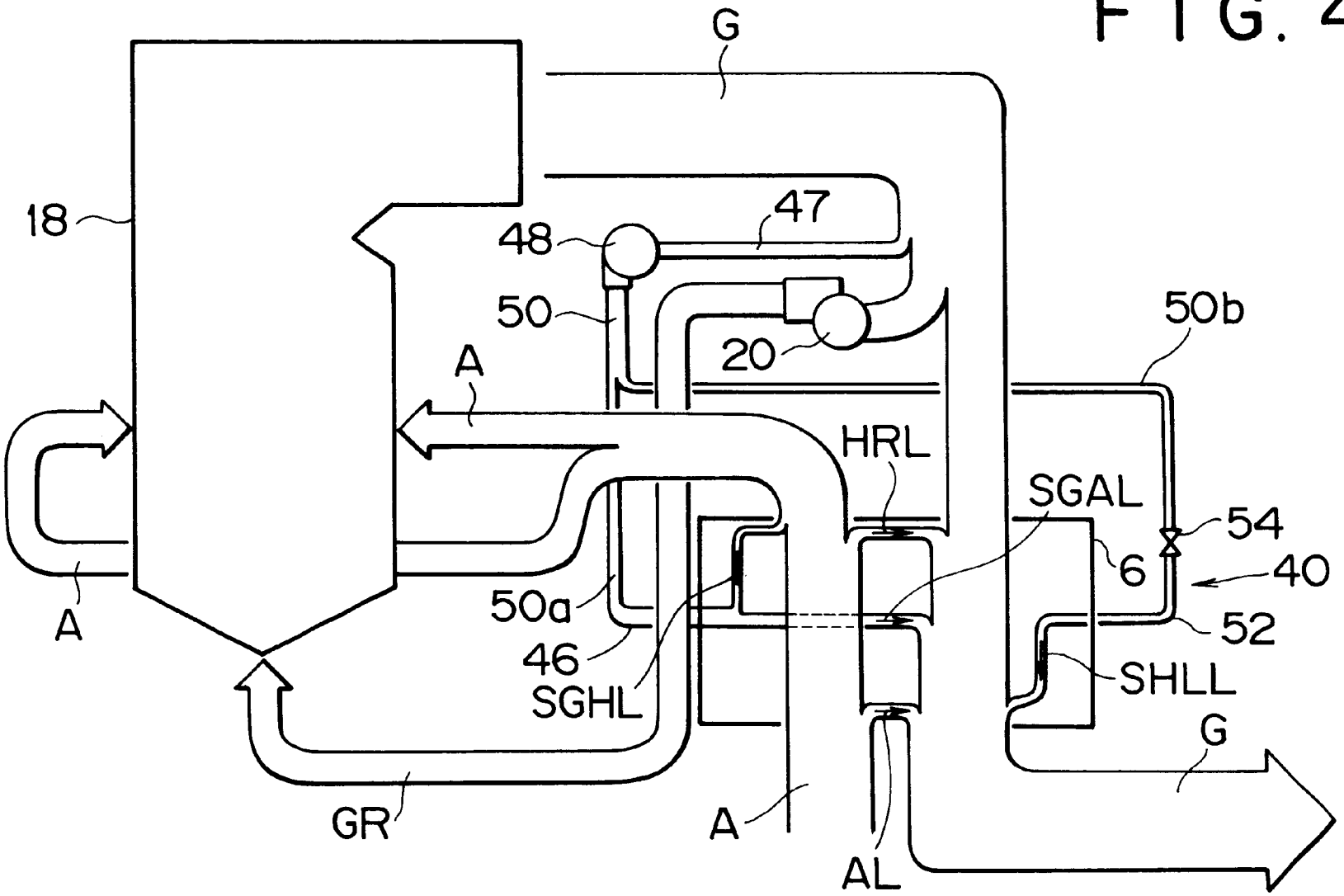
FIG. 4 is a view schematically showing the whole construction of a boiler and a rotary type regenerative heat exchanger according to a third embodiment of the present invention.

Next, a rotary type regenerative heat exchanger according to a third embodiment of the present invention will be explained below with reference to FIG. 4. FIG. 4 is a view schematically showing the whole construction of a boiler and a rotary type regenerative heat exchanger according to the third embodiment of the present invention.

In this third embodiment, the seal gas introducing duct provided in the above first and second embodiments is provided on both the housing 6 on the air side and the housing 6 on the gas side. More specifically, in the third embodiment, a branch pipe 47 is provided at an upstream side from a position locating the rotary type regenerative heat exchanger 40 and the circulating gas fan 20, and then, branches and takes out a part of gas which is discharged from the boiler 18 and flows into the rotary type regenerative heat exchanger 40. The branch pipe 47 is provided with a seal gas fan 48 for applying a pressure to the taken-out gas. A seal gas pipe 50 is arranged at a downstream side of the seal gas fan 48. Further, the seal gas pipe 50 is branched into a pipe 50*a* and a pipe 50*b*. The pipe 50*a* is connected to a seal gas introducing duct 46 which is attached to the housing 6 on the air side and has one end opening in a space between the rotor 4 and the housing 6 on the air side. On the other hand, the pipe 50*b* is connected to a seal gas introducing duct 46 which has one end opening in a space between the rotor 4 and the housing 6 on the gas side. In this case, the pipe 50*b* is provided with a pressure control valve 54. By the pressure control valve 54, the pressure of the seal gas SG introduced into the housing 6 on the gas side is controlled so as to become equal to the aforesaid inlet gas pressure (Pgi).

An operation of the rotary type regenerative heat exchanger thus constructed according to the third embodiment will be explained below. A part of gas, which is discharged from the boiler 18, is taken out from the branch pipe 47 as a seal gas SG at an upstream side from a position locating a rotary type regenerative heat exchanger 40 and a circulating gas fan 20, and then, is pressurized to a value of the inlet air pressure (Pai) or more by means of the seal gas fan 48. One of the pressurized seal gas SG reaches the seal gas introducing duct 46 provided on the housing 6 on the air side via the pipe seal gas pipe 50 and the pipe 50*a*, and then, is introduced from the seal gas introducing duct 46 into a space (first space) surrounded by the rotor 4, the housing 6 on the air side, the bypass seal 26 and the axial seal 28. Meanwhile the other of the pressurized seal gas SG is supplied via the seal gas pipe 50 and the pipe 50*b*, and then, is controlled by means of the pressure control valve 54 so that the pressure seal gas SG becomes equal to an inlet gas pressure (Pgi). Thereafter, the pressurized seal gas SG reaches a seal gas introducing duct 52 provided at the housing 6 on the gas side, and then, is introduced from the seal gas introducing duct 52 into a space (second space) surrounded by the rotor 4, the housing 6 on the gas side, the bypass seal 26 and the axial seal 28.

As a result, the pressure of the aforesaid first space becomes high; therefore, it is possible to effectively prevent an air bypass leak ABL which has conventionally generated. Further, since the air bypass leak ABL is effectively prevented, a low temperature air A on the inlet does not mix with a high temperature air A on the outlet. Therefore, the temperature of air A on the outlet becomes high, so that a heat efficiency of the boiler can be improved. Moreover, in this third embodiment, the pressure of the aforesaid second space becomes high; therefore, it is possible to effectively prevent a gas bypass leak GBL which has conventionally generated. Further, since the gas bypass leak GBL is effectively prevented, the quantity of gas contributing to heat exchange increase as compared with the cases of the first and second embodiments, so that the heat efficiency of the boiler 18 can be improved.

Also, in this third embodiment, like the above first and second embodiments, the seal gas SG in the aforesaid first space flows into the air outlet side as a seal gas high temperature leak SGHL in the housing 6 on the air side, and then, is mixed into the outlet air A. However, the temperature of the gas seal SG at this time is higher than the inlet air temperature; therefore, there is almost no influence of lowering the heat efficiency of the boiler 18 as compared with the conventional rotary type regenerative heat exchanger in which the air bypass leak ABL has generated. Although the seal gas axial leak SGAL is generated, this leak has no influence on the heat efficiency of the boiler 18. Meanwhile the seal gas SG in the aforesaid second space flows into the gas outlet side as a seal gas low temperature leak SGLL in the housing 6 on the gas side, and then, is mixed into the outlet gas G, and thereafter, is discharged from the chimney stack.

Also, in this third embodiment, it is possible to improve a heat efficiency of the whole steam power plant which comprises the boiler 18 and the rotary type regenerative heat exchanger 40 as compared with the conventional one, like the above first and second embodiments.

Thus, in the third embodiment, it is possible to prevent both air bypass leak ABL and gas bypass leak GBL, so that the heat efficiency of the boiler 18 can be further greatly improved as compared with the above first and second embodiments.

Figure 5:
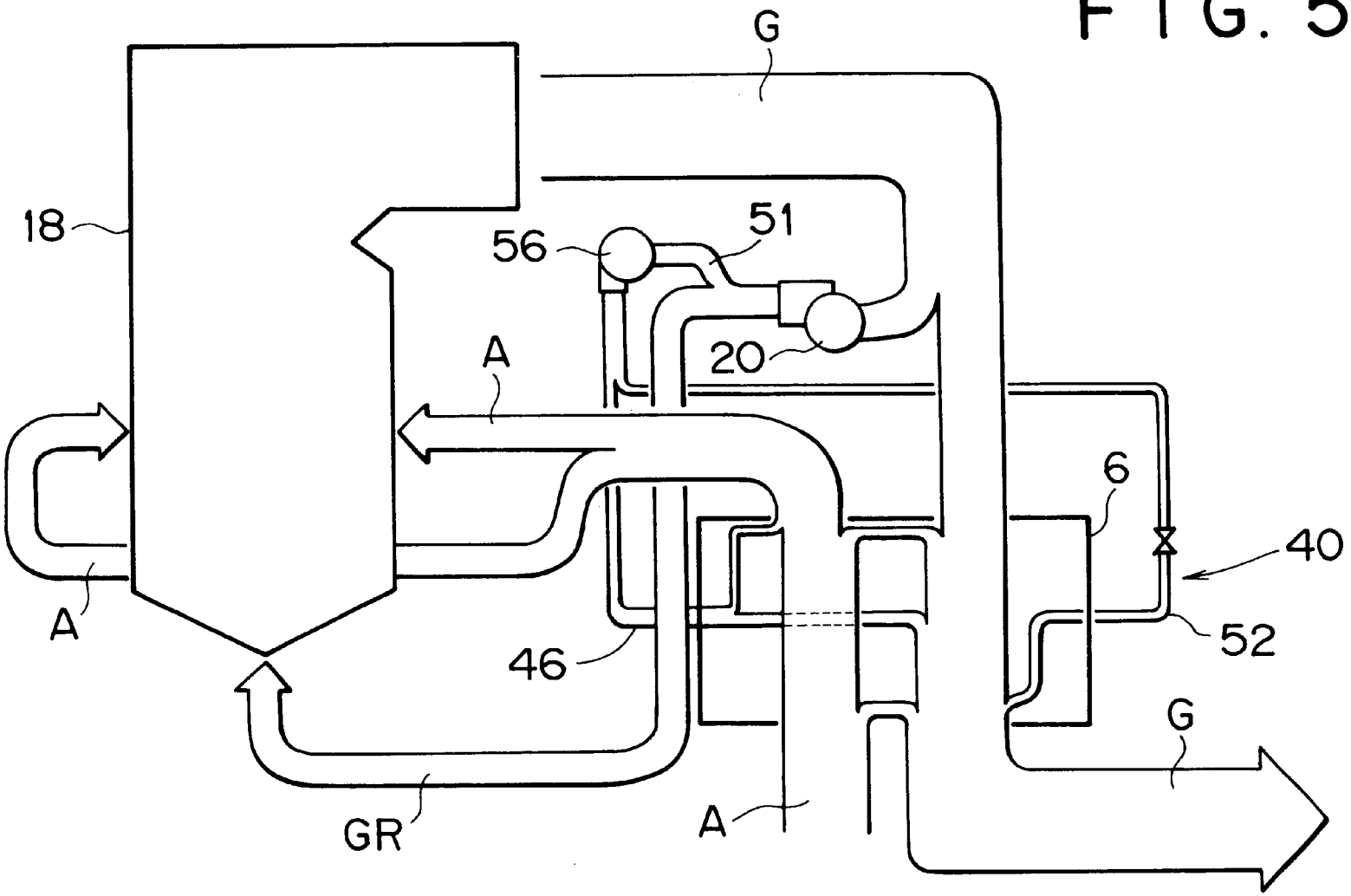
FIG. 5 is a view schematically showing the whole construction of a boiler and a rotary type regenerative heat exchanger according to a fourth embodiment of the present invention.
Figure 6:
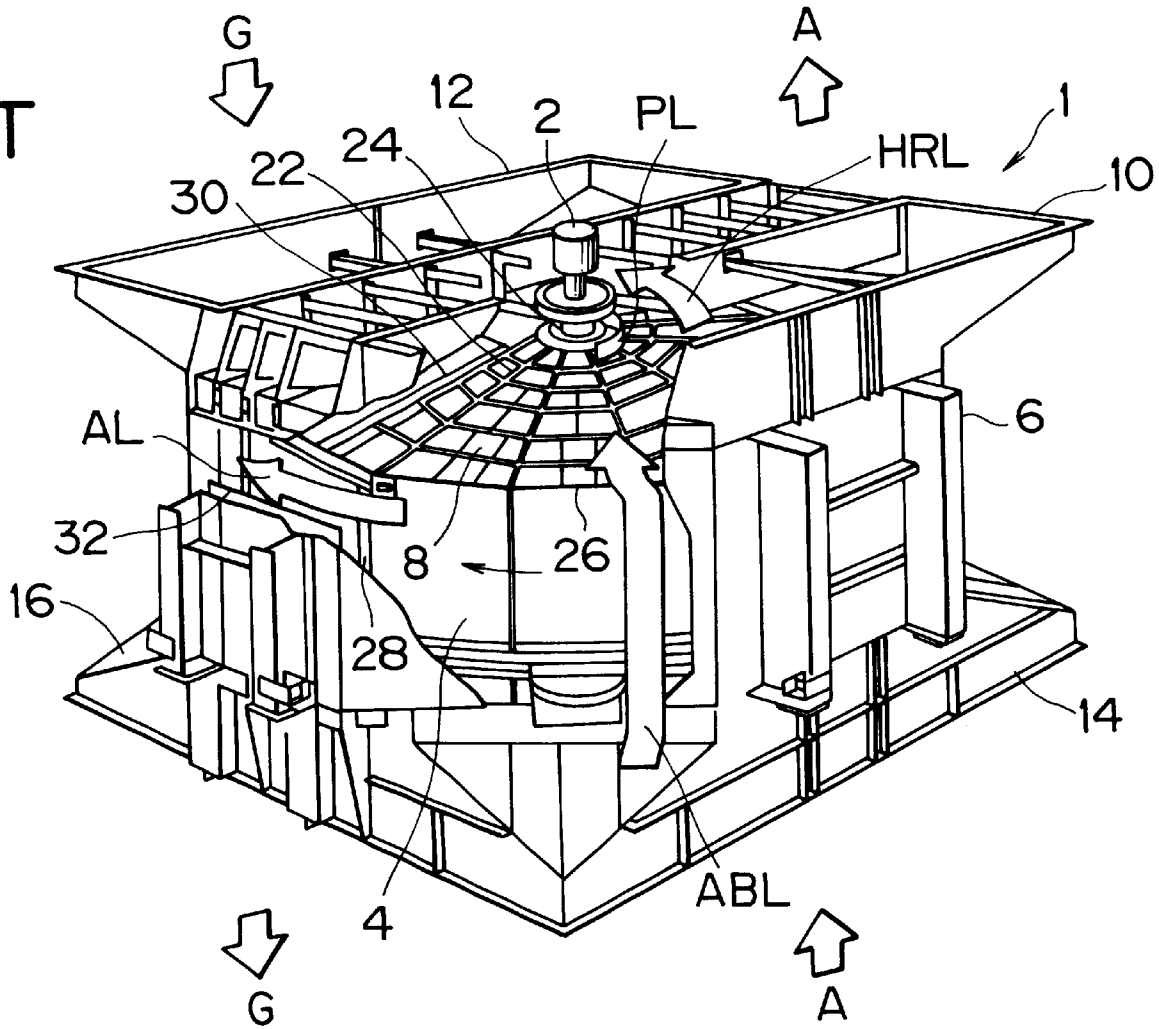
FIG. 6 RELATED ART
FIG. 6 is a perspective view in partly cross section showing a conventional rotary type regenerative heat exchanger.
Figure 7:
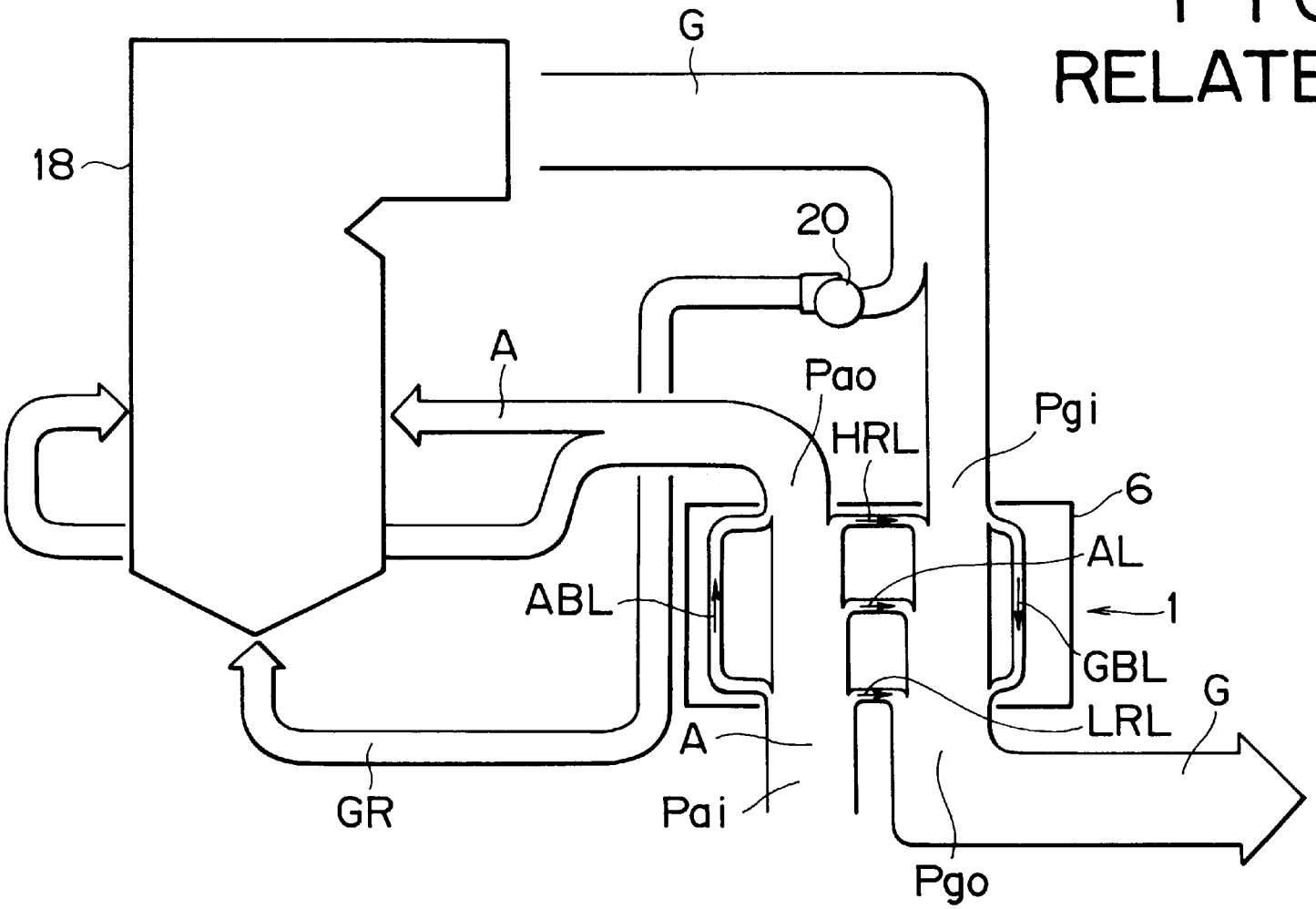
FIG. 7 RELATED ART
FIG. 7 is a view schematically showing the whole construction of a boiler and the conventional rotary type regenerative heat exchanger.

Next, a rotary type regenerative heat exchanger according to a fourth embodiment of the present invention will be explained below with reference to FIG. 5. FIG. 5 is a view schematically showing the whole construction of a boiler and a rotary type regenerative heat exchanger according to the fourth embodiment of the present invention. In this fourth embodiment, the construction is basically the same as the aforesaid third embodiment except the following matters. More specifically, in this fourth embodiment, in order to take out a part of gas, a branch pipe 51 and a seal gas fan 56 are provided at a downstream side from the circulating gas fan 20. As a result, the taken-out gas is already pressurized to some degree by means of the circulating gas fan 20, so that the capacity of the seal gas fan 56 can be made small as compared with that of the third embodiment.

Many other variations and modifications of the invention will be apparent to those skilled in the art without departing from the spirit and scope of the invention. The above-described embodiments are, therefore, intended to be merely exemplary, and all such variations and modifications are intended to be included within the scope of the invention as defined in the appended claims.

The disclosure of Japanese Patent Application No.9-349876 filed on Dec. 19, 1997 including specification, claims, drawings and summary are incorporated herein by reference in its entirety.

What is claimed is:

1. A rotary type regenerative heat exchanger comprising:

a rotor rotating around a central shaft;

a heat accumulator which is constructed in a manner that a heated fluid and a heating fluid filled in the rotor alternately pass therethrough by a rotation of the rotor to repeat heat accumulation and radiation;

a housing provided so as to house the rotor;

take-out means for taking out a part of the heating fluid;

pressurizing means for pressurizing the taken-out heating fluid to a predetermined pressure; and a pressurized fluid introducing passage which is provided in the housing so as to introduce the pressurized heating fluid into a predetermined space formed between the rotor and the housing.

2. The rotary type regenerative heat exchanger according to claim 1, wherein said pressurized fluid introducing passage is provided on the heated fluid side of the housing, the heating fluid side of the housing, or on both heated fluid side and heating fluid side of the housing.

3. The rotary type regenerative heat exchanger according to claim 1, wherein said take-out means branches and takes out a part of the heating fluid before or after passing through the heat accumulator.

4. The rotary type regenerative heat exchanger according to claim 2, wherein said take-out means branches and takes out a part of the heating fluid before or after passing through the heat accumulator.

5. The rotary type regenerative heat exchanger according to claim 1, wherein said take-out means branches and takes out a part of gas at a downstream side from a circulating gas fan which returns a part of the gas discharged from a boiler to the boiler as a re-circulating gas again.

6. The rotary type regenerative heat exchanger according to claim 2, wherein said take-out means branches and takes out a part of gas at a downstream side from a circulating gas fan which returns a part of the gas discharged from a boiler to the boiler as a re-circulating gas again.

* * * * *